United States Patent [19]

Grahn

[11] Patent Number: 4,974,893

[45] Date of Patent: Dec. 4, 1990

[54] WASTE RECOVERY AND DISPOSAL KITS

[76] Inventor: Paul E. Grahn, 17515 17th Ave. West, Lynnwood, Wash. 98037

[21] Appl. No.: 424,688

[22] Filed: Oct. 20, 1989

[51] Int. Cl.[5] ..... A01K 29/00

[52] U.S. Cl. ..... 294/1.3; 15/104.8; 15/257.1; 206/223

[58] Field of Search ..... 294/1.1, 1.3–1.5, 294/55; 15/104.8, 257.1, 257.6, 257.8; 119/1; 206/223, 466, 496; 220/94 A; 229/117.09, 117.11, 117.12; 383/4, 6, 7, 12, 22, 25, 119

[56] References Cited

U.S. PATENT DOCUMENTS

| | | | |
|---|---|---|---|
| 1,733,219 | 10/1929 | Duvall | 294/1.3 X |
| 3,286,826 | 6/1984 | Stoll | 294/1.3 |
| 3,676,887 | 7/1972 | Klein | 294/1.3 |
| 3,767,247 | 10/1973 | Wetzler | 294/1.3 |
| 3,850,467 | 11/1974 | Johnson | 294/1.3 |
| 4,017,015 | 4/1977 | Jefferson | 294/1.3 |
| 4,103,952 | 8/1978 | Thompson | 294/1.3 |
| 4,138,153 | 2/1979 | Brown | 294/1.3 |
| 4,205,869 | 6/1980 | Mathis | 294/1.3 |
| 4,230,354 | 10/1980 | Claras | 294/1.3 |
| 4,252,356 | 2/1981 | Tokuzumi | 294/1.3 |
| 4,272,116 | 6/1981 | Tufte, Jr. | 294/1.3 |
| 4,715,495 | 12/1987 | Henry | 294/1.3 |
| 4,752,093 | 6/1988 | Haber et al. | 294/1.3 |

FOREIGN PATENT DOCUMENTS

| | | | |
|---|---|---|---|
| 2556560 | 6/1985 | France | 294/1.3 |
| 2199476 | 7/1988 | United Kingdom | 294/1.3 |

*Primary Examiner*—Johnny D. Cherry
*Attorney, Agent, or Firm*—Hughes & Multer

[57] ABSTRACT

A kit or assembly which can be used to collect and dispose of animal wastes. The kit is composed of a container for the waste and an implement which can be packaged in the container and is employed to push, scoop, or scrape the waste from the surface on which it is deposited into the container or as a stop for immobilizing the deposit of waste with the container being slid under the deposit to transfer the waste material to the container in that modus operandi. The container has a rigid base with a handle at the end thereof opposite the open end of the container. This allows the user to easily manipulate the container or to hold the container firmly against the surface on which the waste is deposited, facilitating the movement of the waste into the container. Once the waste material has been recovered, a flap at the open end of the container can be trained around the base and adhesively attached to the base to securely close the open container end.

8 Claims, 3 Drawing Sheets

WASTE RECOVERY AND DISPOSAL KITS

TECHNICAL FIELD OF THE INVENTION

The present invention relates to kits for recovering and disposing of feces and other animal wastes.

More particularly, the present invention relates to novel, improved kits of the character identified in the preceding paragraph which allow animal wastes to be recovered, packaged, and disposed of in a sanitary manner and without soiling one's hands or clothing.

BACKGROUND OF THE INVENTION

Increasing populations of humans and their pets, especially dogs, have resulted in the disposal of animal wastes becoming a serious and expanding problem, especially in urban areas. In an effort to combat this problem, large cities such as New York have enacted ordinances requiring that dogs be leashed and that owners or other handlers clean up feces deposited by their pets. Elsewhere, strong pressures are exerted to induce persons to similarly clean up after their pets in the interest of maintaining an attractive environment and to enable others to move freely about without soiling their shoes or feet.

Numerous devices for recovering and disposing of animal feces and their shortcomings are described in U.S. Pat. No. 4,272,116 issued 9 June 1981 to Tufte, Jr. for APPARATUS AND METHOD OF DISPOSING OF PET WASTE AND THE LIKE.

Tufte, Jr. purportedly overcomes the disadvantages of these feces retrieval systems with a kit which is composed of a collapsible container with rigid walls and a spatula which can be used to push feces into the container and then assembled to the container to form a closure. While it may not have the drawbacks of other feces recovery and disposal devices, the arrangement proposed by Tufte, Jr. does have its disadvantages. One is that it is constructed in its entirety of a rigid, thus relatively heavy, stock. This makes the Tufte, Jr. device comparatively expensive and, also, bulky, a common contributor to high shipping costs. These drawbacks are not insignificant because of the large number of containers—365 per year or more —that may be consumed in cleaning up after a single animal and the huge numbers of pets that are kept by law abiding and conscientious persons in environments dictating that feces not be left where they are deposited.

Another salient disadvantage of the Tufte, Jr. device is that its container must be erected and end flaps folded and tapped together before the device can be used. Even this seemingly minor effort would discourage many persons from using the Tufte, Jr. device.

Still other drawbacks of the Tufte, Jr. device are that the tabs he employs do not securely fasten the spatula to the container, and the container is not at all odorproof after it has been sealed. Furthermore, the Tufte, Jr. construction does not lend itself to being sealed and reopened to clean up additional deposits of feces, a feature which is desirable for obvious reasons.

Other devices for retrieving and disposing of feces are disclosed in U.S. Pat. Nos.: 4,017,015 issued 12 April 1977 to Jefferson for DISPOSABLE BIODEGRADABLE ENVIRONMENTAL ANIMAL FECES WASTE SCOOP AND CONTAINER; 4,138,153 issued 6 Feb. 1979 to Brown for SANITARY SELF-CONTAINED FECAL WASTE CONTAINER; 4,230,354 issued 28 Oct. 1980 to Claras for PICK UP AND DISPOSAL KIT FOR PET ORDURE; and 4,252,356 issued 24 Feb. 1981 to Tokuzumi for BAG FOR PACKAGING ANIMAL'S DROPPINGS; and 4,715,495 issued 29 Dec. 1987 to Henry for DISPOSAL KIT.

Tokuzumi's bag does not require the assembly steps of Tufte, Jr. However, the Tokuzumi device has a drawback which may be sufficiently serious to make the device impractical. This is that no provision is made for pressing the bottom side of the bag against the surface on which feces have been deposited while keeping the bag open so that the feces can be pushed into the bag. This would make the recovery of waste material especially difficult if the bag was employed on an uneven and/or yielding surface such as grass, for example.

A further drawback of the Tokuzumi device is that the arrangement used to close the open end of the bag does not provide a tight seal. As a result, offensive odors and fluid components of the recovered waste material may escape to an undesirable extent.

The container disclosed by Claras has the same disadvantages as the one proposed by Tokuzumi. There is no satisfactory way to both keep the bag open and hold it against the surface on which the feces have been deposited. Also, the Claras container seems to lack any practical way of sealing it, once the waste material has been propelled into the bag. In addition, the Claras construction is relatively complex. As a result, his device would probably be too expensive to use on a day-to-day basis.

Complexity is similarly a drawback—probably fatal—of the Brown device. Also disqualifying the Brown device from a practical viewpoint is its involved mode of operation. For example, the user must manipulate the bag to a considerable extent after it has been filled before it may be sealed. Like others, Brown has therefore disclosed a device with a mode of operation which is complex enough that many persons will choose not to use it.

Furthermore, a twist tie is used to seal the bag once it is open and has been closed. However, no provision is made for making that fastener easily available to the user or for keeping it from dropping onto the ground or being lost, for example.

Another disadvantage of the Brown device is that there is no obvious way of propelling the feces into his bag. Merely engaging the teeth of the shovel member at the front of the bag with the feces as instructed by the patentee would not accomplish this goal.

Jefferson's feces disposal kit is believed by me to also be impractical. Erecting two interfitting boxes, as is required to ready his device for use, would certainly not be acceptable to many, if not most, potential users. Also, these boxes would have to be fabricated in their entirety from a relatively heavy and correspondingly expensive material; and the dies needed to generate the complex blank shown by Jefferson would be expensive.

The Henry proposal would appear to be entirely impractical. There is only the flimsiest of connections between the container he employs and the handle by which that container is manipulated. Consequently, particularly once feces have been loaded into the container, there would be nothing to prevent the container from bending away from the handle and discharging its contents.

SUMMARY OF THE INVENTION

I have now invented, and disclosed herein, certain new and novel kits or devices for recovering and disposing of feces and other animal wastes; and these are free of the drawbacks appurtenant to the devices discussed above and previously proposed for the same purpose. In particular, my novel waste disposal kits are simple; inexpensive; extremely convenient to use; and constructed in a manner which facilitates handling, shipping, and storage. The collected materials are easily sealed in a fecal container in a manner which minimizes offensive odors and allows the waste material to be disposed in a sanitary manner.

Briefly, my novel waste disposal kits and devices have two components—a collapsible container in which the waste material is collected and an implement which is packaged in the container and is used to push, scoop, and scrape the waste material into the container. Alternatively, this implement can be used as a stop and the container slid under the thus immobilized waste material to transfer that material from the surface on which it is deposited to the interior of the bag.

The container has a rigid base with a handle at, and protruding beyond, a closed end of the container. This handle is firmly fixed to the base and allows the user to easily and firmly hold the container against even an uneven and/or unyielding surface such as grass, making it easy to transfer the waste material from the surface to the container, even in these circumstances. Also, this handle makes it easy for the user to manipulate the bag and slide it under the waste material being recovered if that optional method of employing my novel waste recovery and disposal kit is being employed because the container cannot bend relative to the base on which the feces-receiving container is mounted.

The container also has top and side walls and is formed from a single bag element blank of lighter weight and correspondingly less expensive material. The blank also has a segment which defines the closed end of the bag and a flap which extends beyond the base of the container. This flap can be trained around and adhesively attached to the base after the feces have been collected to seal the container securely and in a manner which inhibits the escape of offensive odors. Fold lines in the top and side walls of the bag element allow the top wall of that element to be collapsed against the base, providing a flat, compact package that is easily handled, stored, and transported.

The implement employed to transfer the waste material into the container is fabricated from a relatively rigid sheet material. It can have a simple, rectangular configuration; and it is dimensioned to fit in the collapsed container.

OBJECTS OF THE INVENTION

From the foregoing, it will be apparent to the reader that one important and primary object of my invention resides in the provision of novel, improved kits or devices for disposing of animal wastes.

Other also important but more specific objects of the invention reside in the provision of such devices or kits which:

can be manufactured and supplied cheaply enough to permit them to be used on a routine, daily basis;

do not require any appreciable assembly or erection or other similar acts prior to use;

can be conveniently and tight sealed after the feces have been collected, thereby inhibiting the escape of odors and allowing the feces to be disposed of in a convenient and sanitary manner;

are composed of a container with a bottom wall or side that can easily be held against the surface from which the waste material is to be removed with the bag in an open configuration so that the waste material can be transferred into the container with equal ease;

in conjunction with the preceding object, have a rigid base supporting the container and a handle so integrated with the base as to eliminate bending between the base and the handle; and can be supplied in a compact, flattened configuration that makes them easy to handle and store and relatively inexpensive to ship.

Other important objects and features and additional advantages of my invention will be apparent to the reader from the foregoing and the appended claims and as the ensuing detailed description and discussion proceeds in conjunction with the accompanying drawing.

DETAILED DESCRIPTION OF THE INVENTION

Figure 1:
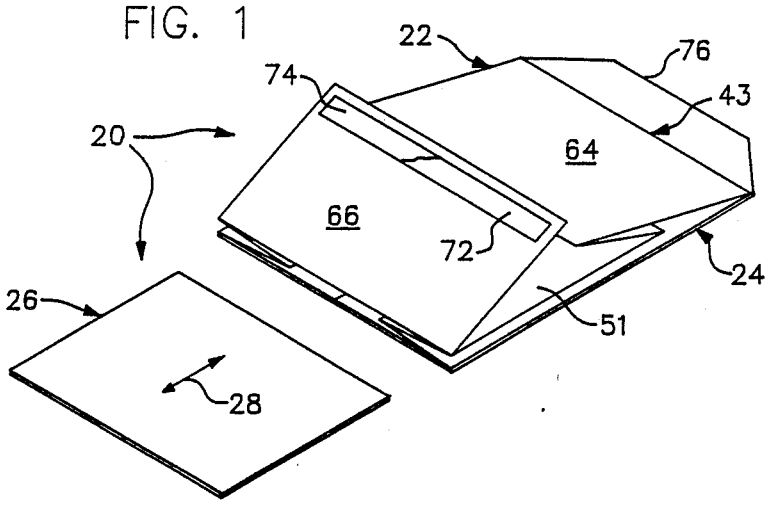
FIG. 1 is a pictorial view of a two-piece waste disposal kit or device embodying the principles of the present invention; this view shows a first, waste container component slightly opened from a flat packaged configuration and a second, component or implement for immobilizing a deposit of or pushing waste material into the container, the latter being shown after removal from the container in which it was theretofore packaged.
Figure 2:
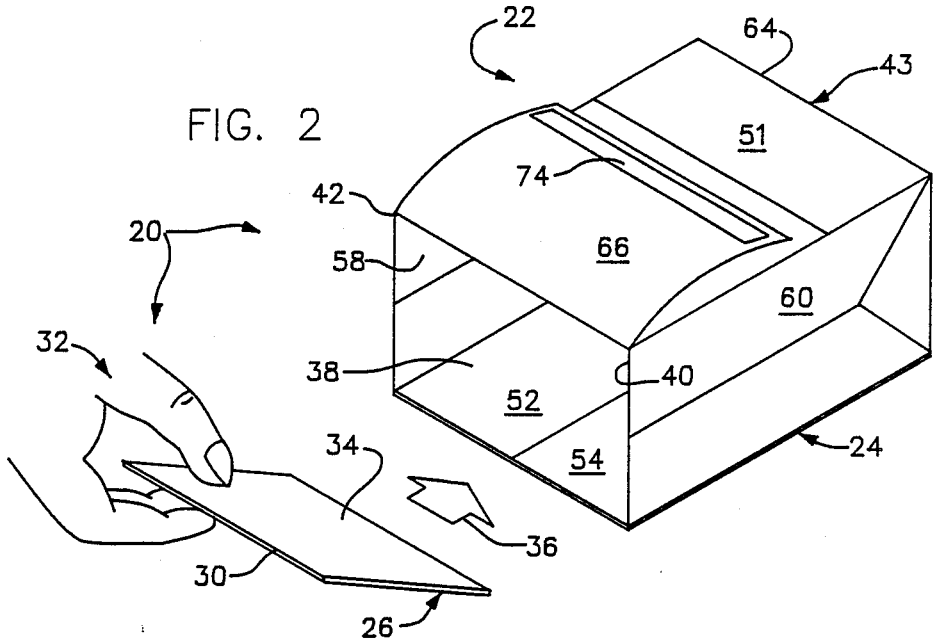
FIG. 2 shows the waste material container fully opened and the cooperating implement positioned to scoop or scrape wastes from the surface on which they were deposited into an open end of the container bag element.
Figure 3:
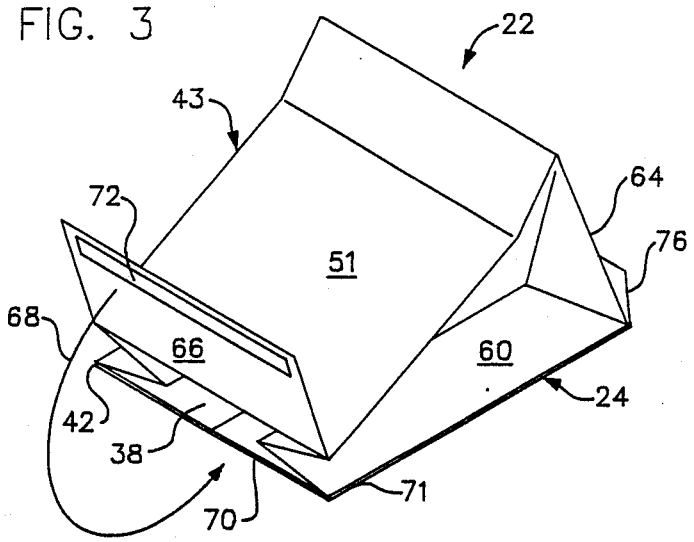
FIG. 3 shows how the container is subsequently sealed to inhibit the escape of odors and collected material, thereby allowing the latter to be disposed of in a safe, convenient, and sanitary manner.
Figure 4:
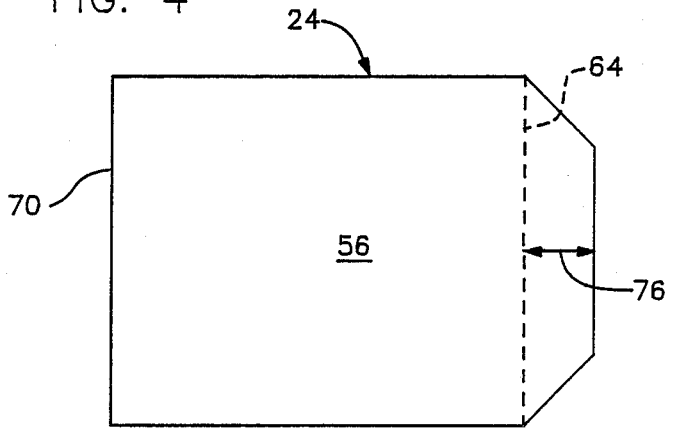
FIG. 4 is a plan view of a rigid base for the container component of the kit shown in FIG. 1.

Referring now to the drawing, FIGS. 1–3 depict a novel kit 20 embodying the principles of the present invention and designed for recovering animal wastes from a surface on which those wastes are found and subsequently disposing of the collected wastes in a convenient and sanitary manner. The kit is supplied in the flattened, compact, easily handled, stored, and transported configuration suggested by FIG. 1.

Animal waste recovery and disposal kit 20 has two components: a collapsible container 22 with a rigid base 24 and a simple, rigid implement 26 for: (1) pushing, scooping, and scraping the waste material from the surface on which that material is found into container 22, or (2) immobilizing a deposit of waste material so that the base 24 of the container can be slid under the deposit to transfer the waste material to the interior of the container. As indicated by the double-headed arrow 28 in FIG. 1, implement 26 is intended to be packaged in container 22 and then removed from that container when kit 20 is employed to recover animal waste material.

Implement 26 is fabricated from a relatively rigid and inexpensive material such as one of the many, commercially available cardboards. Also in the interest of economy, this component will typically have the simple, rectangular configuration shown in FIGS. 1 and 2. This configuration provides an upper segment 30 which is easily gripped by the hand 32 of the user (see FIG. 2) and a lower segment 34. This latter is employed in transferring the waste material being collected from the surface on which it is deposited to container 22 and, as shown by arrow 36 in FIG. 2, allows this to be done without the waste material coming into contact with, and soiling, the user's hand. Afterwards, implement 26 is returned to the container component 22 of kit 20 and disposed of along with the container and its other contents.

Referring now to all five figures of the drawing, I pointed out above that the container 22 in which the waste material is collected is supplied in a flattened, compact form (see FIG. 1) which makes it easy to handle, transport and store. Only a few seconds are required to expand the container into the open ended, boxlike configuration shown in FIG. 2 and thereby provide a chamber 38 with a mouth 40 for the waste material being collected. Thereafter, the open end 42 of the container can be easily closed and sealed to minimize the escape of offensive odors and to ensure that the collected wastes remain in the bag and can accordingly be disposed of in a sanitary manner.

As is apparent from FIG. 1–3, container 22 is composed of two elements. One is the above briefly referred to rigid base 24. The other is a baglike element 43. That component is made by: (1) folding the blank 44 shown in FIG. 5 along the dotted fold lines shown in that figure and collectively identified by reference character 46; (2) joining the opposite edges 48 and 50 of the blank 44 together as with an appropriate, adhesively backed tape (not shown); and (3) adhesively or otherwise bonding together those segments of the blank that are juxtaposed after the folding process has been completed.

Blank 44 is fabricated from a lighter and typically flimsier material than base 24, and this material is consequently much less expensive. The container 22 of waste recovery and disposal kit 20 therefore has a decided cost advantage over those competing waste disposal kits which feature waste-receiving containers fabricated from cardboards and similar rigid material. Papers such as those from which bags are commonly made can be used. Such papers are readily creased along lines such as those identified by reference character 46 in FIG. 5 to facilitate the expanding of bag element 43 from the flattened configuration in which it is supplied (FIG. 1) to the open, boxlike configuration in which it is employed (FIG. 2) and the subsequent collapsing of the bag element top wall 51 against the rigid base 24 of the container at the open end 42 of the contained in the course of closing that container end.

Figure 5:
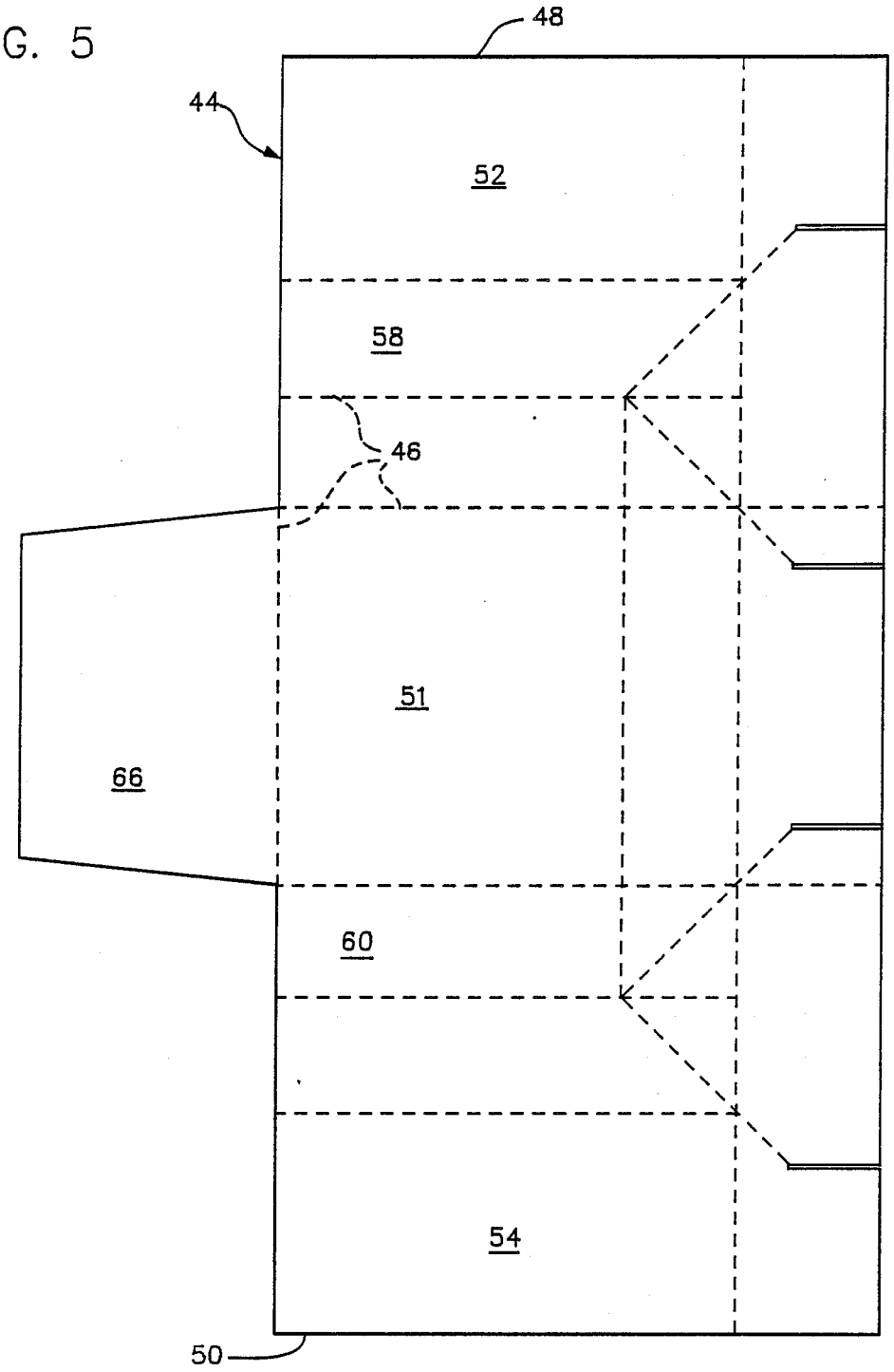
FIG. 5 is a plan view of a blank which is folded to provide a container bag element with top and side walls, a closed end, a flap for sealing an open end of the bag element after the waste material is collected therein, and segments which are attached to the container base to assemble the bag element to the latter; in this figure, solid lines represent score lines and dotted lines identify fold lines.

The manufacture of bags from blanks of the same general character as that shown in FIG. 5 are well-known and in widespread commercial use, and the particular steps employed in converting blank 44 into a bag element as shown in FIGS. 1–3 are not part of my invention. The details of blank 44 and the conversion of that blank into bag element 43 will, as a consequence, not be discussed herein.

Generated in the course of folding blank 44 into the configuration shown in FIGS. 1–3 are two, ultimately juxtaposed, integral, coplanar segments 52 and 54. Bag element 43 is assembled to its associated, rigid base 24 by adhesively or otherwise bonding these segments 52 and 54 to the upper surface 56 of the base.

Bag element 43 also has side walls 58 and 60, the above-mentioned top wall 51, and a closed end 64 (best shown in FIG. 1) at the end of container component 22 furtherest removed from its open end 42. As shown in FIG. 1, the side and upper walls 58, 60 and 51 of bag element 43 can be folded on various ones of the creases or fold lines 46 to bring adjacent wall segments together and collapse the bag element to the flattened, FIG. 1 configuration in which waste recovery and disposal kit 20 is supplied. These same fold lines also allow the top wall 51 of bag element 43 to be collapsed against the base 24 of container 22 at the open end 42 thereof after the animal wastes have been collected as shown in FIG. 3 to facilitate the closure and subsequent sealing of that container end.

In this regard, a flap 66, provided as an integral segment of blank 44, extends from bag element top wall 51 past that end 70 of rigid base 24 at the open end 42 of container 22. Once the specified waste material has been collected and the top wall 51 of bag element 43 collapsed against rigid base 24 at the open end 42 of container 22, flap 66 is trained around the base at that end of the container (see arrow 68 in FIG. 3). Flap 66 thus cooperates with the side and top walls 58, 60, and 51 of bag element 43 to close the open end 42 of container 22 conveniently and in a manner which keeps the contents of the container from escaping while, in addition, inhibiting the escape of offensive odors from bag element 43.

Flap 66 is secured to the bottom side 71 of rigid container base 24 to further these goals by a strip of adhesive 72 (see FIG. 3). Until the user is ready to seal flap 66 to base 24, the adhesive is protected by the usual, detachable peel strip 74 (see FIG. 1). This method of sealing container 22 also has the advantage that it allows that container to be easily reopened and resealed if it becomes necessary or advantageous to transfer additional waste material to a previously used bag. This might be the case if a dog has more than one bowel movement during a single walk, for example.

Referring now most particularly to FIGS. 1 and 3, I pointed out above that the rigid base 24 of container 22 allows the user to easily and conveniently: (1) manipulate the container component 22 of animal waste disposal and recovery kit 20, and (2) press the base 24 of the opened container (see FIG. 2) against the surface from which waste materials are being removed so that those materials can be easily transferred to the waste receiving chamber 38 in the bag element 43 of container 22, making it simple and easy to recover the waste material in container component 22.

Base 24 can be formed from any inexpensive, relatively rigid material. This may be the same cardboard as that from which implement 26 is fabricated or, as a further example, a heavier and stiffer cardboard.

Base 24 has the same dimensions as the bottom of bag element 43 and, consequently, extends from one side to the other of the bag element and from the open end 42 of container 22 to the closed end 64 of that disposal kit component. That the base 24 extends from end-to-end and from side-to-side of bag element 43 and that it is rigid over its entire length and span are important in realizing my goal of facilitating the transfer of waste materials from the surfaces on which they are deposited to waste recovery and disposal kit container 22.

An integral, trapezoidal, coplanar handle 76 extends from base 24 beyond the closed end 64 of disposal kit container 22 (at its widest edge, this handle equals the base in width). The user of kit 20 employs this handle to manipulate waste container base 24 under a deposit of waste material or to hold base 24 against the surface from which animal wastes are being recovered. Cardboards and similar materials are rigid enough that thus pressing handle 76 against the contaminated surface will also keep base 24 in firm contact with that surface at the opposite, open end of container 22.

While feces constitute the major problem, it is also desirable in many settings that other animal wastes such as vomit, birds and other dead creatures, etc. be removed from the surfaces on which they are found. The novel waste disposal kits or devices disclosed herein can also be used to advantage to recover such waste materials, and the appended claims are consequently intended to cover all waste disposal kits or devices within the scope of those claims, irrespective of the use to which they may be put.

Also, the invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A kit for disposing of animal wastes which consists in its entirety of: a collapsible, disposable; waste receiving container having an open end and an implement which can be employed in association with said container to transfer wastes from a surface on which said wastes have been deposited to said container through the open end thereof, said container having a flat, rigid base extending from the open end of the container toward the opposite end thereof; side and top walls fabricated from a more flexible, lighter gauge material than said base, said side and top walls being so interrelated with each other and the base that said container can be opened up from a compact, flattened configuration to a configuration in which said container provides a waste-receiving chamber with a mouth defined by the open end of the container; and a flat handle means with an upper surface and a lower surface, an operative position relative to said base, and lying beyond said opposite end of said container by which said container can be manipulated to facilitate the transfer of said wastes to said container, said handle means being an extension of said base integrated with the base from one side of the base to the other to substantially preclude bending between the handle means and the base, said base having upper and lower surfaces, and the upper and lower surfaces of said base and said handle means lying entirely in the same planes with said handle means in its operative position relative to the base.

2. A kit as defined in claim 1 wherein said side and top walls are fabricated from a single piece of material which can be folded with sharp creases between adjacent segments thereof to facilitate the collapsing of said container into a flattened and therefore easily handled, stored, and shipped configuration.

3. A kit as defined in claim 2 wherein said top and side walls are segments of a single sheet of material and said sheet has at least one additional segment which can be affixed to said base with said top and side walls interrelated as aforesaid.

4. A kit as defined in claim 1 which has a flap integral with and extending from said top wall past the open end of the container, whereby said top wall can be collapsed against said base and said flap then trained over that end of the base at the open end of the container to securely close the open end of the container.

5. A kit as defined in claim 4 in which said flap has an adhesive thereon for affixing said flap to said base after said flap has been trained therearound to thereby securely retain the collected animal wastes in the container.

6. A kit as defined in claim 1 wherein the side and top walls of said container each have at least two integral segments that are separated by a fold line and can be folded toward each other along that line to collapse said top and side walls against said base.

7. A kit as defined in claim 1 wherein said container has wall means at said opposite end thereof which is integral with said top and side walls and provides a closed container end.

8. A kit as defined in claim 1 wherein said implement is fabricated of a rigid sheet material and is dimensioned to fit within the collapsed container.

* * * * *